United States Patent [19]

Paret

[11] 4,192,324

[45] Mar. 11, 1980

[54] PROCESS FOR CONSTITUTING A LARGE SURFACE OF NATURAL TOBACCO, IN PARTICULAR FOR MAKING CIGAR WRAPPERS

[75] Inventor: Jacques Paret, Fleury-les-Aubrais, France

[73] Assignee: Service d'Exploitation Industrielle des Tabacs et des Allumettes, Paris, France

[21] Appl. No.: 825,383

[22] Filed: Aug. 17, 1977

[30] Foreign Application Priority Data

Aug. 18, 1976 [FR] France ..... 76 25029

[51] Int. Cl.[2] ..... A24B 3/00

[52] U.S. Cl. ..... 131/149; 131/122

[58] Field of Search ..... 131/15, 149, 148, 122, 131/123, 125, 140 R, 140 C

[56] References Cited

U.S. PATENT DOCUMENTS 3,744,498 7/1973 Imbert ..... 131/149

*Primary Examiner*—V. Millen

*Attorney, Agent, or Firm*—Holman & Stern

[57] ABSTRACT

A process for constituting a large surface of natural tobacco, in particular for making cigar wrappers comprising the steps of:

(a) stripping the biggest rib of natural tobacco leaves;

(b) dividing each leaf into two half-leaves;

(c) arranging the half-leaves in a plane in succession along a continuous row in such a manner that the rectilineal side of each half-leaf corresponding to the removed rib is orientated in a fixed direction, transverse to the longitudinal axis of the large surface of tobacco forming said row, that said half-leaves are adjoining each other, that the remaining ribs are in relief on the same side of the plane and have the same orientation;

(d) covering with tobacco fragments the areas between the half-leaves where the tobacco is missing;

(e) maintaining all the leaf fragments in their respective arrangement.

13 Claims, 6 Drawing Figures

PROCESS FOR CONSTITUTING A LARGE SURFACE OF NATURAL TOBACCO, IN PARTICULAR FOR MAKING CIGAR WRAPPERS

The present invention relates to a method for constituting a large surface of natural tobacco, in particular for making cigar wrappers.

It is already known to make continuous strips of natural tobacco leaves: these strips supply one of the possible answers to the need for automatization in the manufacture of cigars.

But most of these known methods have serious disadvantages: some of these processes, which aim at the "perfection" of the strip have the disadvantage of being rather slow and of producing much refuse; other processes, aiming rather at the speed of the process, utilize tobacco leaves which are not stripped and/or the ribs of which are not all oriented in the same direction and on the same side of a plane; finally, some processes, putting the emphasis on reducing to the minimum the refuse when forming the strip itself and then during the manufacture of the cigars, produce tobacco strips of relatively reduced width which are therefore fragile.

The object of the present invention is to obviate such disadvantages as much as possible. The method consists in forming a large surface with natural tobacco. It is characterized in that:

the half-leaves are arranged in succession along a continuous row after having been stripped of the biggest rib, under the following conditions:

(a) the rectilineal side of each half-leaf corresponding to the removed rib is orientated in a fixed direction, transverse to the longitudinal axis of the large surface of tobacco forming said row, (b) they are at least adjoining each other, (c) the ribs are in relief on the same side of the plane, (d) the ribs have the same orientation;

The areas between the half-leaves where the tobacco is missing are covered with tobacco fragments;

All the leaf fragments are maintained in their respective arrangement.

This procedure has numerous advantages.

On the one hand, the tobacco leaves used have been previously stripped and are arranged in such manner that the secondary ribs are on the same side of a plane and have one same orientation: the "quality" requirement is therefore fulfilled and the large tobacco surface will be usable for manufacturing luxury objects.

On the other hand, the half-leaves are arranged in succession along a continuous strip in such manner that the rectilineal side of each half-leaf corresponding to the removed rib is orientated in a fixed direction and definitely transverse to the longitudinal axis of the large tobacco surface: the latter is therefore relatively wide and consequently resistant. Above all, this width of the large tobacco surface provides the possibility of duplicating the uses and utilization processes of the latter. It is understood that the expression "longitudinal axis of the large tobacco surface" corresponds to a direction without reference to a symmetry.

In fact, the spirit of the present invention departs basically from that of the traditionally used processes. Its aim is not to provide a continuous strip of tobacco the width of which being exactly adapted to a precise use, but rather to provide a large tobacco surface which may be thereafter easily used while providing a choice between various manufacturing processes.

Finally, and this is an essential criterion, the process according to the invention is very interesting from an economic point of view:

The continuous strip is formed not with fragments of thongs pre-cut according to determined contours, which would necessarily cause rejects, but entire half-leaves which will be totally used. There is practically no loss at all of material.

Of course, when several half-leaves are arranged one after the other, there appears between them, due to their conformation, areas where the tobacco is missing. It is therefore foreseen to cover with tobacco leaf fragments the areas between the half-leaves where tobacco is missing.

The process according to the invention provides the possibility to arrange the half-leaves according to various modalities. The choice of one modality in relation to the others will be made with reference to the manufactured products, as well as the manufacturing processes which will be used.

According to one of the modalities, the tobacco half-leaves are arranged in such manner that their side which is rectilineal and was previously adjacent the central rib is substantially perpendicular to the longitudinal axis of the tobacco large surface.

A large tobacco surface is thereby obtained and it will be thereafter possible to cut fragments to the desired shape according to needs.

According to another modality, the tobacco half-leaves are arranged in such manner that their secondary ribs are substantially perpendicular to the longitudinal axis of the tobacco large surface.

This tobacco large surface thereby obtained will be advantageously used for the manufacture of non conical cigars or cigarilos: it will be possible to use the inside of cigars, or bound core, the length of which corresponds to the width of the tobacco large surface; it will be sufficient to roll said bound cores along the longitudinal axis of the tobacco large surface. It will be thereby possible to obtain in a simple manner the cigar or cigarilo wrappers, while ensuring an orientation of the secondary ribs of the wrapper parallel to the cigar longitudinal axis.

According to a third modality, it is foreseen to arrange the tobacco half-leaves in such manner that their secondary ribs are substantially parallel to the longitudinal axis of the tobacco large surface. It will be possible for instance to longitudinally cut the tobacco large surface thereby obtained for continuously wrapping or underwrapping the cigars in the same way as cigarettes are made.

According to any one of the hereabove disclosed modalities, the invention provides that the half-leaves are arranged by substantially matching their larger deflection with the middle longitudinal area of the tobacco large surface. In such manner that the part of each half-leaf with maximum surface is positioned substantially in the center of the future tobacco large surface: the areas where tobacco is missing are therefore shifted towards the side edges of the tobacco large surface; this facilitates the covering of said areas where tobacco is missing.

The hereabove explained features of the present invention provide various combinations.

It is in particular possible to arrange the tobacco half-leaves top against bottom, that is the top of a half-leaf alternating with the bottom of another half-leaf. The intervals left by the half-leaves between themselves and where tobacco is missing substantially correspond to the shape of the tops of the entire leaves.

It is also possible to arrange the tobacco half-leaves in such manner that their side which is substantially rectilineal and was previously adjacent the central rib is at least adjoining the convex side of the adjacent half-leaf. The leaves remain therefore with more numerous intervals of smaller dimension between themselves than in the previous modality. But this solution is advantageous due to the greater facility to put it into practice. In order to avoid any mistake, it suffices not to mix right hand side half-leaves with left hand side half-leaves.

Once the half-leaves are arranged in a continuous strip, the process according to the invention foresees to cover the areas between the half-leaves where the tobacco is missing with tobacco leaf fragments. This covering operation may be performed in two ways. The choice of one or the other way will be made according to the arrangement of the half-leaves which has been adopted with a view to making the large tobacco surface, also according to the necessity or not to have a large tobacco surface with maximum width, and according finally to the availability of raw material and the manufacturing requirements.

One of the solutions consists in covering the areas between the half-leaves where tobacco is missing with leaf fragments pre-cut elsewhere. Thus, the process according to the invention foresees in particular to cover the areas of the large surface where tobacco is missing with the pre-cut tops of the blunted tobacco leaves. This solution is particularly adapted to the hereabove already mentioned modality, according to which the half-leaves are arranged in such manner that they leave intervals between themselves, the shape and dimensions of which correspond substantially to those of the entire leaf tops. It should be stressed that the secondary ribs which are at the top of the leaves are not numerous and very little apparent. The quality requirement is therefore respected.

The second solution is more advantageous in the case of the other modality where the intervals between the half-leaves are more numerous and of smaller dimensions. This solution consists in arranging the half-leaves along a continuous strip, said half-leaves being obtained by stripping the tobacco leaves under the following conditions:

(a) the rectilineal side of each half-leaf corresponding to the removed rib is orientated in a fixed direction, definitely transverse to the longitudinal axis of the tobacco large surface which is forming said strip, (b) they are at least adjoining each other;

(c) the relief of the ribs is on the same side of the plane;

(d) the ribs have the same orientation;

To fix the limits of the tobacco large surface by cutting part of the top and/or the bottom of each half-leaf along at least one line which is substantially parallel to the longitudinal axis of said large surface;

To arrange the tobacco fragments thus cut out in the areas of the large surface where tobacco is missing;

To maintain all the leaf fragments in their respective arrangement.

More precisely, it is foreseen to cut at the ends of the tobacco half-leaves fragments of minimum dimensions but sufficient for covering the areas of the large surface where tobacco is missing. This feature of the invention provides the possibility to keep at its minimum the width reduction undergone by the tobacco large surface, therefore to avoid the production of waste: fragments cut out at the extremities of the half-leaves should be able to cover a surface at least equal and maximum slightly larger than that formed by the areas where tobacco is missing.

In the precise case where the tobacco half-leaves are arranged in such manner that their side which is substantially rectilineal and was previously adjacent the central rib is at least adjoining the convex side of the adjacent half-leaf, the process according to the invention provides a preferred solution: its consists in setting the limits of the future tobacco large surface by cutting part of the point and/or the bottom of each half-leaf along at least a line which is parallel to the longitudinal axis of said large surface and which devides substantially in halves the area where tobacco is missing.

In fact, one has been able to establish that the shape and dimensions of the extreme parts of the half-leaves correspond substantially, but in reverse direction, to those of the intervals between the half-leaves where tobacco is missing. It is therefore foreseen to perform the longitudinal cut in such manner that the height of the extreme part of the half-leaf to be cut is substantially equal to the depth of the interval remaining between two half-leaves after a longitudinal cut and where tobacco is missing: any waste of raw material is thereby avoided and the tobacco large surface retains its maximum width.

It is foreseen to perform at least one longitudinal cut. But, according to the arrangement of the half-leaves, it may be more advantageous to perform one or more of such cuts. Thus, when their rectilineal side is placed substantially perpendicular to the longitudinal axis of the large tobacco surface, the half leaves limit, on either side, intervals where tobacco is missing: it is therefore advantageous to perform two longitudinal cuts.

On the contrary, in the case of the two other modalities hereabove mentioned in which the secondary ribs of the half-leaves are either perpendicular or parallel to the longitudinal axis of the tobacco large surface, it is preferable to perform only one longitudinal cut: due to the combination on the one hand of the arrangement of the half-leaves, and on the other hand of the shape which is not tapering but on the contrary substantially "bulging" at their ends, the half-leaves leave intervals between themselves where tobacco is missing on one side only.

Once the longitudinal cut of the extreme parts of the half-leaves is performed, the process according to the invention foresees to pivot through an angle of 180° the cut off fragments at the ends of the half leaves before inserting them in the large tobacco surface.

This pivoting movement may be obtained by pivoting said cut off fragments in their own plane. This solution has the advantage that while maintaining their secondary ribs in the same plane and in the same orientation as previously, to realize in a very simple manner the positioning of the tobacco fragments which is the most advantageous as regards their positive surface for covering the areas where tobacco is missing: it is in fact in this position that the tobacco fragments will match as accurately as possible the shape of the areas of the large surface where tobacco is missing.

In a more decomposed manner, it is also possible to proceed in the following manner: to provide two successive rotations through 180° each and about two axes orthogonal in relation to each other, of the fragments cut off at the ends of the half-leaves.

Then whatever the solution adopted for covering with tobacco fragments the areas of the large surface where tobacco is missing, the process according to the invention foresees the alignment of the rectilineal edges of the tobacco fragments inserted in the tobacco large surface in such manner as to form, at least partially, the rectilineal edges of said large surface. This provides an adjustment at best of the tobacco fragments inserted in the large tobacco surface, in relation to the areas which have to be covered.

And, for maintaining in their respective arrangements all the elements forming the large tobacco surface, it is foreseen to utilize one or more of known means, such as a partial overlapping of the tobacco leaves, suction or gluing.

The large tobacco surface thus obtained may be used, as previously seen, according to various modalities. Thus, for instance, it is possible to transversely cut out wrappers the length of which corresponding to the width of the large tobacco surface. This procedure which is simple and quick provides a great degree of automatism in the making of cigars.

But it should be recalled that the length of the wrappers is not always substantially equal to the width of the large tobacco surface; it may be superior and in such a case, the large tobacco surface should be used differently; it can also be inferior, which causes an important mass of rejects.

In order to obviate in particular such disadvantages, it is foreseen to cut out the large tobacco surface by performing cuts distant from each other of the larger length or of the larger width of the wrappers which have to be manufactured, then to unite the fragments thus obtained for obtaining fragments of the required length. A solution will be to cut transversely the large tobacco surface, the distance between two cuts corresponding to the length of the required wrapper, the fragments thus obtained being then united in such manner that the length of the wrapper corresponds hereafter to the width of the large tobacco surface. This way of proceeding provides a quick and simple further use of the large tobacco surface as well as an optimum use of said surface whatever the dimension of the required wrappers. It should be noted that the expression "distance between two cuts" is to be understood in a very wide sense. Thus, in the case where one or more longitudinal cuts are provided in the large tobacco surface, the edges of the large tobacco surface will be assimilated to a cut.

It is emphasized that the following description set forth in connection with the accompanying drawings refers to a few examples only which are not limitative of the process according to the invention.

FIGS. 1, 3, 4 and 5 show different modalities for covering the areas where tobacco is missing;

Figure 1:
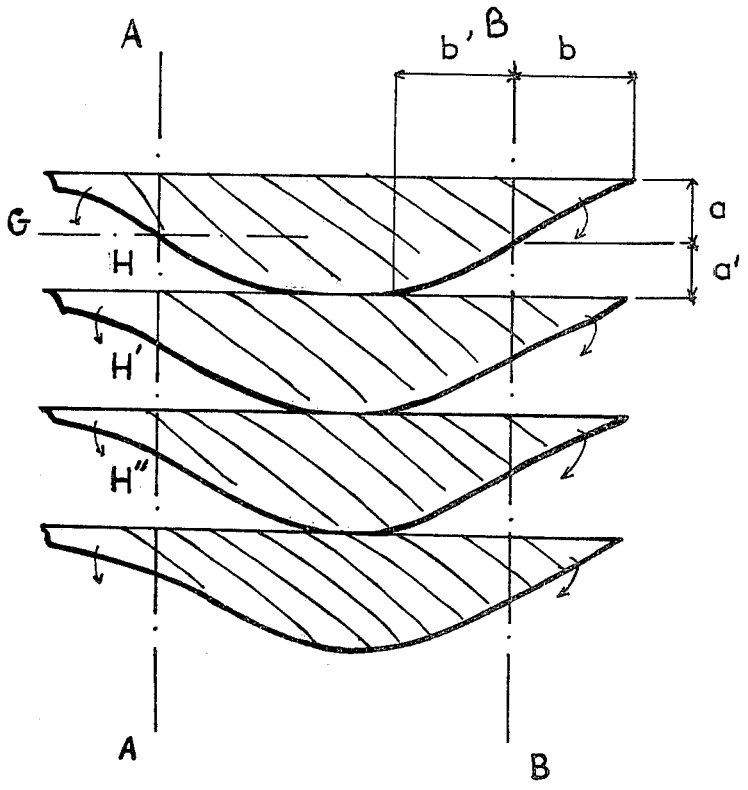
FIGS. 1, 2, 3 and 5 show each a different modality for the arrangement of the half-leaves forming the large tobacco surface.

Refering to FIG. 1, the side substantially rectilineal and previously adjacent the central rib of each half-leaf is at least adjoining the convex side of the adjacent half-leaf. The relief of the secondary ribs is on the same side of a plane and the ribs have the one same orientation. And the side substantially rectilineal is perpendicular to the longitudinal axis of the continuous strip of half-leaves.

Figure 2:
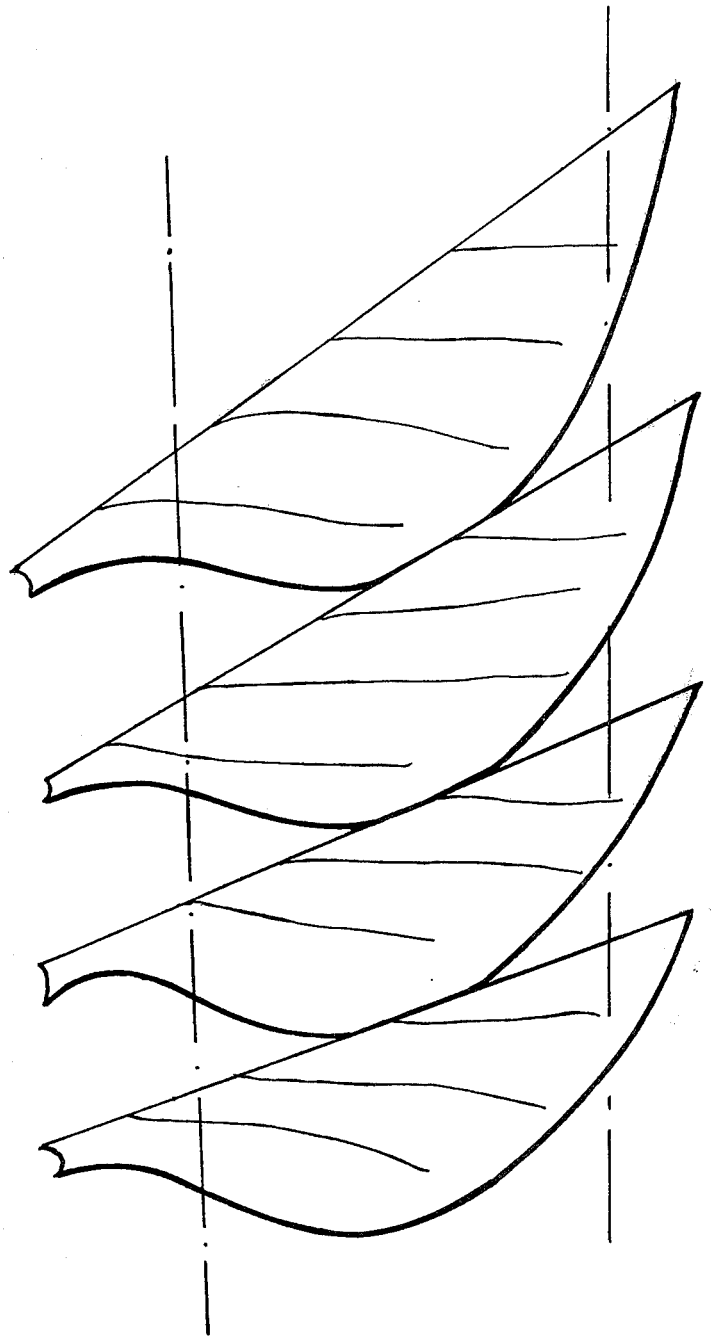

FIG. 2 shows a similar arrangement of the half-leaves. But in this case, the side of the half-leaf which is substantially rectilineal is only transverse to the longitudinal axis of the continuous strip of half-leaves: the inclination of the half-leaves relative to the transverse axis of the large tobacco surface is such that the secondary ribs of the half-leaves are parallel to said transverse axis.

Figure 5:
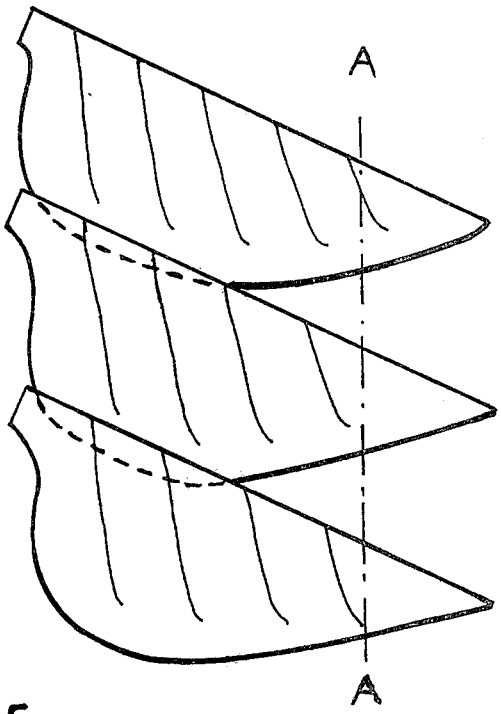

In the case of FIG. 5, the inclination of the half-leaves relative to the transverse axis of the large tobacco surface is such that the secondary ribs of the half-leaves are substantially parallel to the longitudinal axis of the large tobacco surface. Due to the fact that their shape is not tapering but rather bulging, the bottoms of the half-leaves suffice for forming an edge to the tobacco large surface. The areas where tobacco is missing are therefore concentrated at the other end of the half-leaves.

Figure 3:
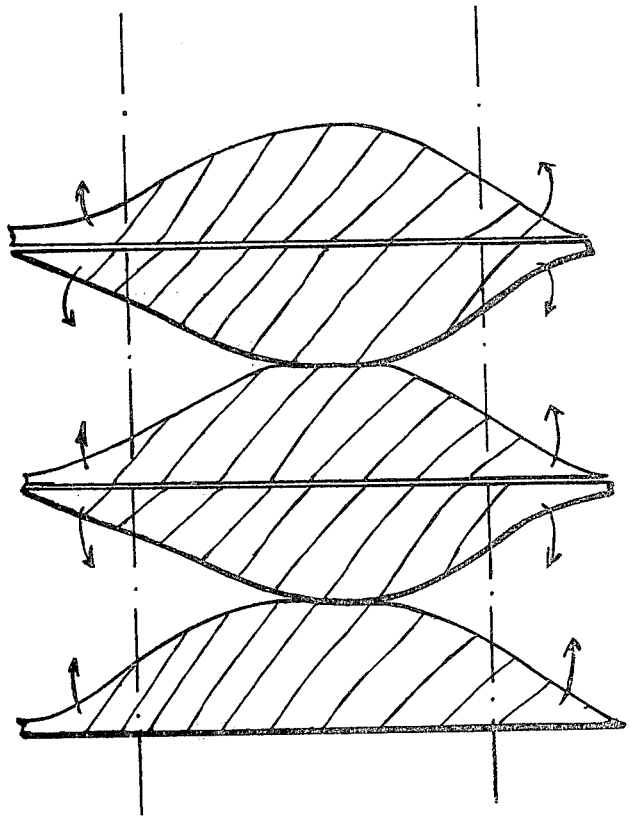

FIG. 3 shows a further example of the arrangement of the half-leaves: they are disposed top to bottom, each end of the bottom being situated between two top extremities. Such an arrangement allows using as well the right hand side half-leaves as the left hand side half-leaves.

In the case of FIG. 1, it is advantageous to cut off the leaf fragments on either side of the continuous row of half-leaves along the dotted lines A and B. The leaf fragments are thereafter pivoted through 180° and placed in the tobacco large surface. So, the a side is positioned at a′ and the b side is positioned at b′.

For obtaining such a result, it is for instance possible to pivot the leaf fragments through 180° and in their plane about a point (H, H′, H″, etc.). It is also possible to subject said leaf fragments to two successive rotations through 180° about two axes orthogonal in relation to each other, such as for instance G and A.

Figure 6:
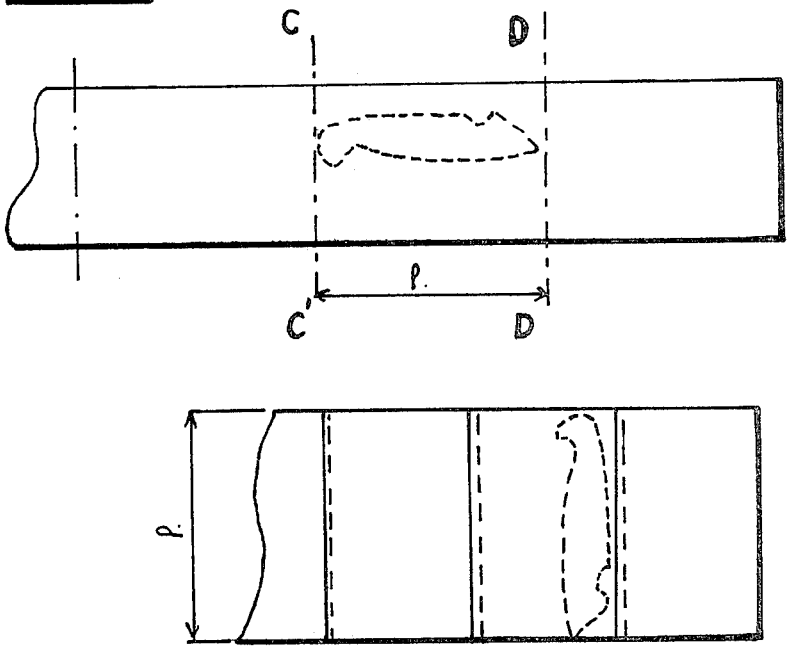
FIG. 6 illustrates an example of an optimal use of the large tobacco surface.

In the case of the example illustrated in FIG. 6, the same processes will be usable. But it should be noted that it will be necessary to perform one longitudinal cut only.

Figure 4:
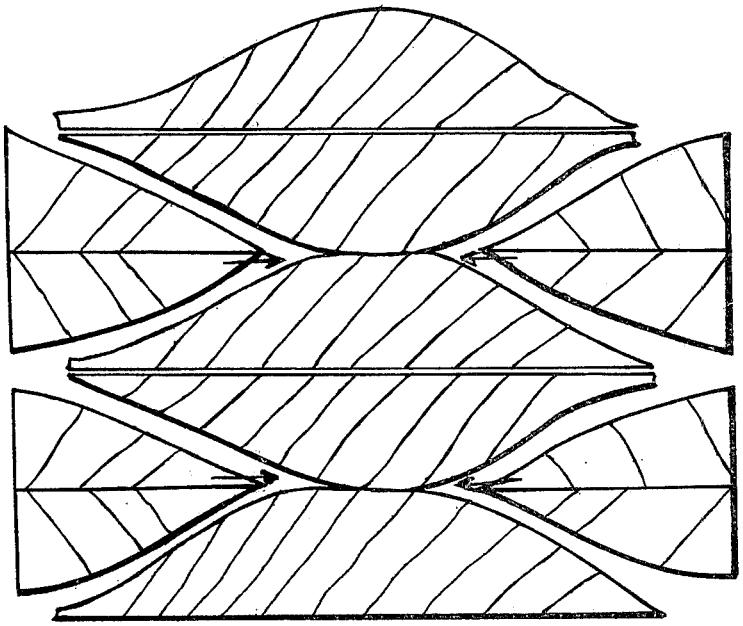

It is also possible to proceed in the same way in the case of FIG. 3. But then, two leaf fragments will have to be used for covering an area where tobacco is missing; said two fragments may be, before being cut off, adjoining or else separated by an area to be covered. It is also possible, in advantageous manner, to cover the intervals between the half-leaves with the tops of the tobacco leaves already blunted (FIG. 4).

The arrangement of the half-leaves as illustrated in FIG. 3 provides the possibility to proceed according to a further modality which is equally advantageous: it is possible to perform only a longitudinal cut in the continuous strip of half leaves, such cut dividing the half-leaves substantially in halves. A limit is thereby set for an edge for the future large tobacco surface. Then, the tobacco fragments situated on one side of the cutting line are displaced in such manner that they cover the intervals where the tobacco is missing and which remain between the leaf fragments situated on the other side of the cutting line: the displaced leaf fragments correspond substantially, from a point of view of shape and dimensions, to the intervals which they come to cover. This solution provides a large tobacco surface where all the secondary ribs have the same orientation.

Once the large tobacco surface is achieved, it is possible with a view to an optimal use of said surface to perform transverse cuts of said large tobacco surface along lines C, D (FIG. 6). The distance between two cuts (1) corresponds to the length of the required wrappers.

Finally, the fragments thus obtained are united to each other in such manner that the cutting lines form the longitudinal edges of the new large tobacco surface.

What I claim is:

1. A process for constituting a large surface of natural tobacco, in particular for making cigar wrappers comprising the steps of:

(a) stripping the biggest rib of natural tobacco leaves;

(b) dividing each leaf into two half-leaves;

(c) arranging the half-leaves in a plane in succession along a continuous row in such a manner that the rectilineal side of each half-leaf corresponding to the removed rib is orientated in a fixed direction, transverse to the longitudinal of the formed continuous row, that said half-leaves are adjoining each other, that the remaining ribs are in relief on the same side of the plane and have the same orientation;

(d) covering with tobacco fragments the areas between the half-leaves where the tobacco is missing;

(e) maintaining all the leaf fragments in their respective arrangement.

2. A process according to claim 1 wherein part of the top or bottom of each half-leaf is cut along at least one line which is substantially parallel to the longitudinal axis of said large surface to fix the limits of said surface and the tobacco fragments thus cut out are arranged in the areas of the large surface where tobacco is missing.

3. A process according to claim 2 wherein are cut at the ends of the tobacco half-leaves fragments of minimum dimensions but sufficient for covering the areas of the large surface where tobacco is missing.

4. A process according to claim 3 wherein the limits of the future tobacco large surface are set by cutting part of the point and/or the bottom of each half-leaf along at least a line which is parallel to the longitudinal axis of said large surface and which devides substantially in halves the area where tobacco is missing.

5. A process according to claim 2 wherein the fragments cut off at the ends of the half leaves are pivoted through an angle of 180° before inserting them in the large tobacco surface.

6. A process according to claim 5 wherein the fragments cut off at the ends of the half-leaves are submitted to two successive rotations through 180° each and about two axes orthogonal in relation to each other.

7. A process according to claim 1 wherein the tobacco half-leaves are arranged in such manner that their side which is rectilineal and was previously adjacent the central rib is substantially perpendicular to the longitudinal axis of the tobacco large surface.

8. A process according to claim 1 wherein the tobacco half-leaves are arranged in such manner that their secondary ribs are substantially perpendicular to the longitudinal axis of the tobacco large surface.

9. A process according to claim 1 wherein the tobacco leaves are arranged in such manner that their secondary ribs are substantially parallel to the longitudinal axis of the tobacco large surface.

10. A process according to claim 1 wherein the half-leaves are arranged by substantially matching their larger deflection with the middle longitudinal area of the tobacco large surface.

11. A process according to claim 1 wherein the tobacco half-leaves are arranged in such manner that their side which is substantially rectilineal and was previously adjacent the central rib is at least adjoining the convex side of the adjacent half-leaf.

12. A process according to claim 1 wherein the areas of the large surface where tobacco is missing are covered with the pre-cut tops of the blunted tobacco leaves.

13. A process according to claim 1 wherein the rectilineal edges of the tobacco fragments inserted in the tobacco large surface are aligned in such manner as to form, at least partially, the rectilineal edges of said large surface.

* * * * *